United States Patent [19]

Cha

[11] 4,166,721

[45] Sep. 4, 1979

[54] DETERMINING THE LOCUS OF A PROCESSING ZONE IN AN OIL SHALE RETORT BY OFF GAS COMPOSITION

[75] Inventor: Chang Y. Cha, Bakersfield, Calif.

[73] Assignee: Occidental Oil Shale, Inc., Grand Junction, Colo.

[21] Appl. No.: 843,442

[22] Filed: Oct. 19, 1977

[51] Int. Cl.[2] ..... G01N 31/12; G01N 33/22; G01N 33/28

[52] U.S. Cl. ..... 23/230 EP; 23/230 PC; 23/926; 299/1; 422/62

[58] Field of Search ..... 23/230 EP, 230 PC; 299/1, 2

[56] References Cited

U.S. PATENT DOCUMENTS

| | | | |
|---|---|---|---|
| 2,772,951 | 12/1956 | Bond | 23/230 EP |
| 3,446,597 | 5/1969 | Bray et al. | 23/230 EP |
| 3,454,365 | 7/1969 | Lumpkin et al. | 23/230 EP |
| 3,740,641 | 6/1973 | Hwang et al. | 23/230 EP X |
| 3,975,157 | 8/1976 | Smith | 23/230 EP |
| 4,076,312 | 2/1978 | Cha et al. | 299/2 |

*Primary Examiner*—Michael S. Marcus
*Attorney, Agent, or Firm*—Christie, Parker & Hale

[57] ABSTRACT

A processing zone advances through a fragmented permeable mass of particles containing oil shale in an in situ oil shale retort in a subterranean formation containing oil shale. The retort has an effluent gas passing therefrom. The effluent gas contains a constituent which is formed, by advancement of the processing zone through the fragmented mass, from a precursor contained in the formation. To determine the locus of the processing zone, formation is assayed at selected locations in the retort for content of the precursor before processing the selected locations, and effluent gas from the retort is monitored for concentration of the selected constituent.

For example, kerogen can be the precursor and effluent gas from the retort can be monitored for the concentration of methane produced by retorting of kerogen in the oil shale.

25 Claims, 4 Drawing Figures

DETERMINING THE LOCUS OF A PROCESSING ZONE IN AN OIL SHALE RETORT BY OFF GAS COMPOSITION

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen", which upon heating decomposes to produce hydrocarbon liquid and gaseous products. It is the formation containing kerogen that is called "oil shale" herein, and the liquid hydrocarbon product is called "shale oil".

A number of methods have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by this reference. This patent describes in situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen containing retort inlet mixture into the retort as a gaseous combustion zone feed to advance the combustion zone through the retort. In the combustion zone oxygen in the combustion zone feed is depleted by reaction with hot carbonaceous materials to produce heat and combustion gas. By the continued introduction of the gaseous combustion zone feed into the combustion zone, the combustion zone is advanced through the retort. The combustion zone is maintained at a temperature lower than the fusion temperature of oil shale, which is about 2100° F., to avoid plugging of the retort, and above about 1100° F. for efficient recovery of hydrocarbon products from the oil shale.

The effluent gas from the combustion zone comprises combustion gas, carbon dioxide from mineral carbonate decomposition, and any gaseous portion of the combustion zone feed that does not take part in the combustion process. This effluent gas is essentially free of free oxygen and contains constituents such as oxides of carbon, water vapor, nitrogen, and sulfurous compounds. It passes through the fragmented mass in the retort on the advancing side of the combustion zone to heat oil shale in a retorting zone to a temperature sufficient to produce kerogen decomposition, called retorting, in the oil shale to gaseous and liquid products and to a residue of solid carbonaceous material.

As used herein, the term "processing gas" is used to indicate gas which serves to advance a processing zone such as a combustion zone, a retorting zone, or both a retorting zone and combustion zone, through the fragmented mass in an in situ oil shale retort, and includes, but is not limited to, an oxygen supplying gas introduced into a retort for advancing a combustion zone and retorting zone through a retort and a hot retorting gas which can be introduced into a retort or generated in a combustion zone in a retort for advancing a retorting zone through a retort.

The liquid products and gaseous products are cooled by cooler particles in the fragmented mass in the retort on the advancing side of the retorting zone. The liquid hydrocarbon products, together with water produced in or added to the retort, are collected at the bottom of the retort and withdrawn to the surface through an access tunnel, drift or shaft. An effluent gas, referred to herein as off gas, containing combustion gas generated in the combustion zone, gaseous products including methane produced in the retorting zone, carbon dioxide from carbonate decomposition, and any gaseous portion of the combustion zone feed that does not take part in the combustion process is also withdrawn from the bottom of the retort.

There are several reasons that it is desirable to know the locus of parts of the combustion and retorting processing zones as they advance through an in situ oil shale retort. One reason is that by knowing the locus of the combustion zone, steps can be taken to control the orientation or shape of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed or warped combustion zone, more cracking of the hydrocarbon products can result. Monitoring the locus of parts of the combustion zone provides information for control of the advancement of the combustion zone to maintain it flat and uniformly perpendicular to the direction of its advancement to obtain high yield of hydrocarbon products.

Another reason that it can be desirable to monitor the locus of the combustion zone is to provide information so the composition of the combustion zone feed can be varied with variations in the kerogen content of oil shale being retorted. Formation containing oil shale includes horizontal strata or beds of varying kerogen content, including strata containing substantially no kerogen, and strata having a Fischer assay of 80 gallons of shale oil per ton of oil shale. If conbustion zone feed containing too high a concentration of oxygen is introduced into a region of the retort containing oil shale having a high kerogen content, oxidation of carbonaceous material in the oil shale can generate so much heat that fusion of the oil shale can result, thereby producing a region of the fragmented mass which cannot be penetrated by retorting gases.

Another reason for monitoring the locus of the combustion and retorting processing zones as they advance through the retort, is to monitor the performance of the retort to determine if sufficient shale oil is being produced for the amount of oil shale being retorted.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon products.

Thus, it is desirable to provide methods for monitoring advancement of combustion and retorting processing zones through an in situ oil shale retort.

SUMMARY OF THE INVENTION

The present invention concerns a process for determining the locus of a processing zone advancing through a fragmented permeable mass of particles in an in situ oil shale retort in a subterranean formation containing oil shale. The retort has an effluent gas passing therefrom, the gas containing a selected constituent where the selected constituent is formed from at least one precursor contained in the formation by advancement of the processing zone through the fragmented mass. The method of the present invention comprises determining content of such a precursor in the formation at selected locations in the retort for processing the selected locations and monitoring effluent gas from the retort before concentration of the selected constituent.

The precursor can be kerogen and the selected constituent can be methane. By assaying formation for kerogen content, it is possible to predict methane production from a retorting zone in the fragmented mass as a function of inlet gas properties and kerogen content of the formation. By measuring the concentration of methane in the effluent gas and thereby determining methane production rate, measured methane production can be compared with predicted methane production. Such a comparison can be used to determine the locus of a retorting zone advancing through the fragmented mass.

DRAWINGS

These and other features, aspects and advantages of the present invention will become more apparent upon consideration of the following description, appended claims, and accompanying drawings where:

Figure 3:
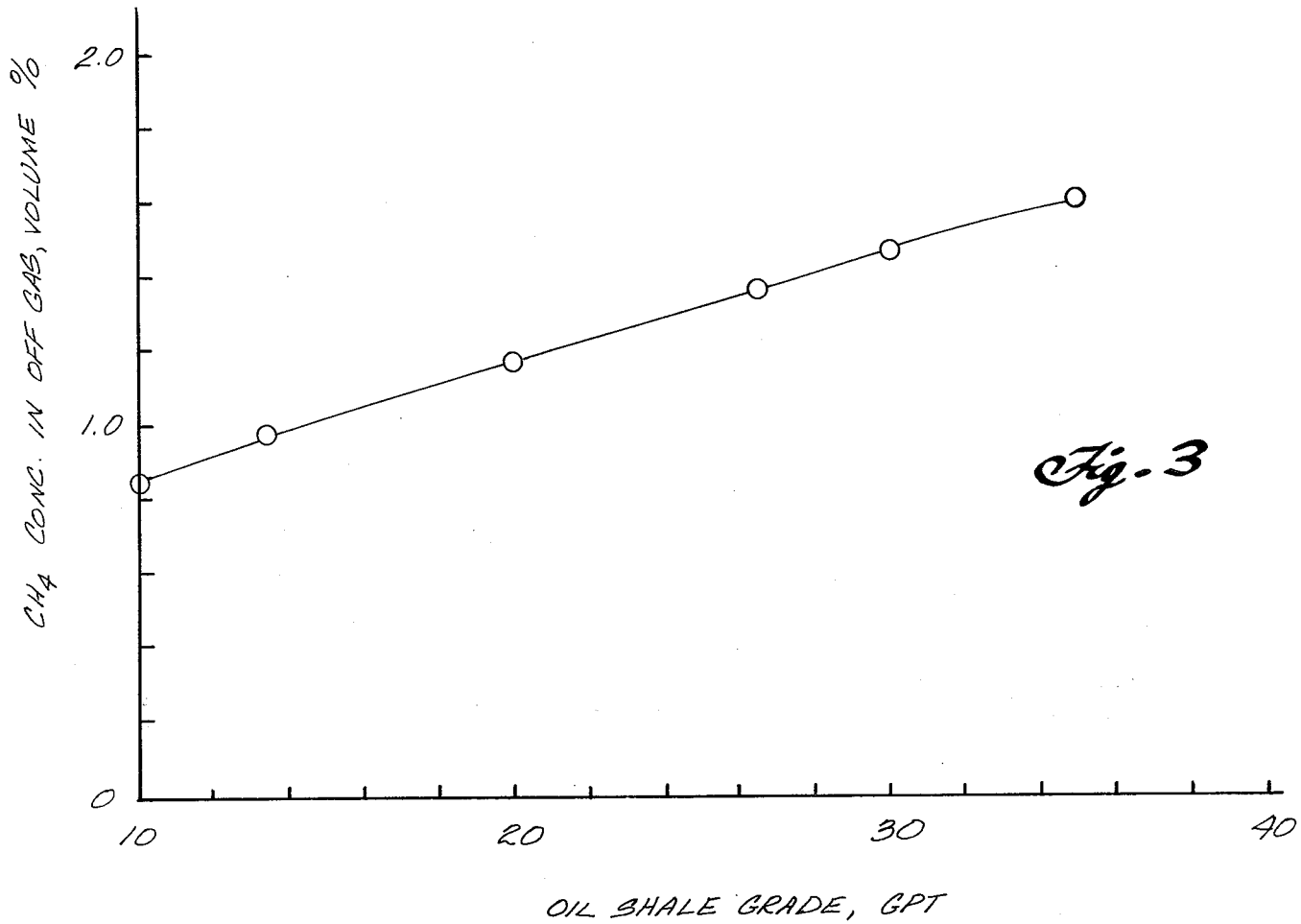
Figure 4:
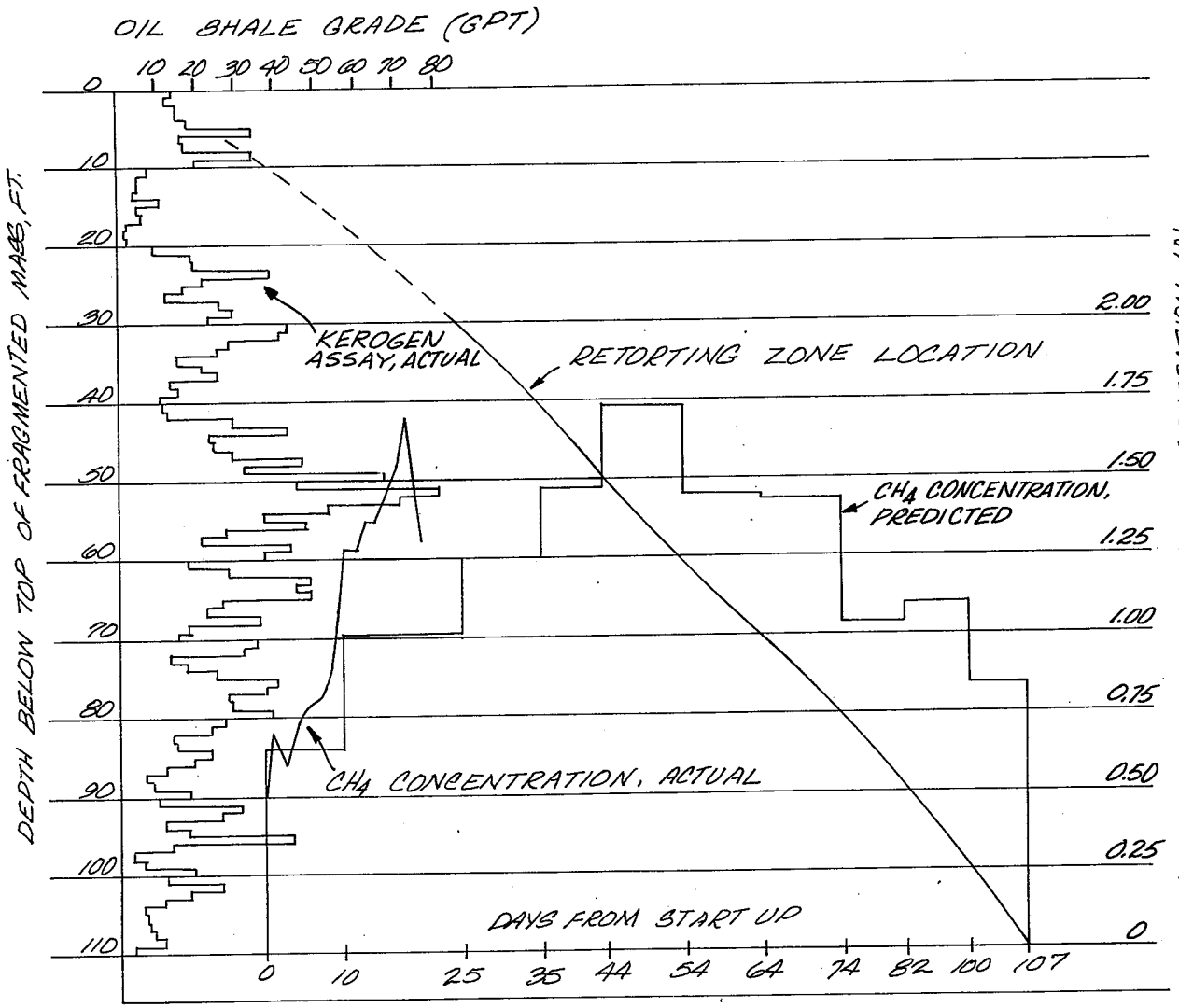

FIG. 3 shows methane concentration in off gas as a function of oil shale grade for an in situ oil shale retort like that of FIG. 1; and FIG. 4 shows for an in situ oil shale retort like that of FIG. 1: oil shale grade as a function of depth below the top of the fragmented mass in the retort; predicted location of the retorting zone during retorting; predicted concentration of methane in off gas from the retort; and actual concentration of methane in the off gas from the retort.

DESCRIPTION

Figure 1:
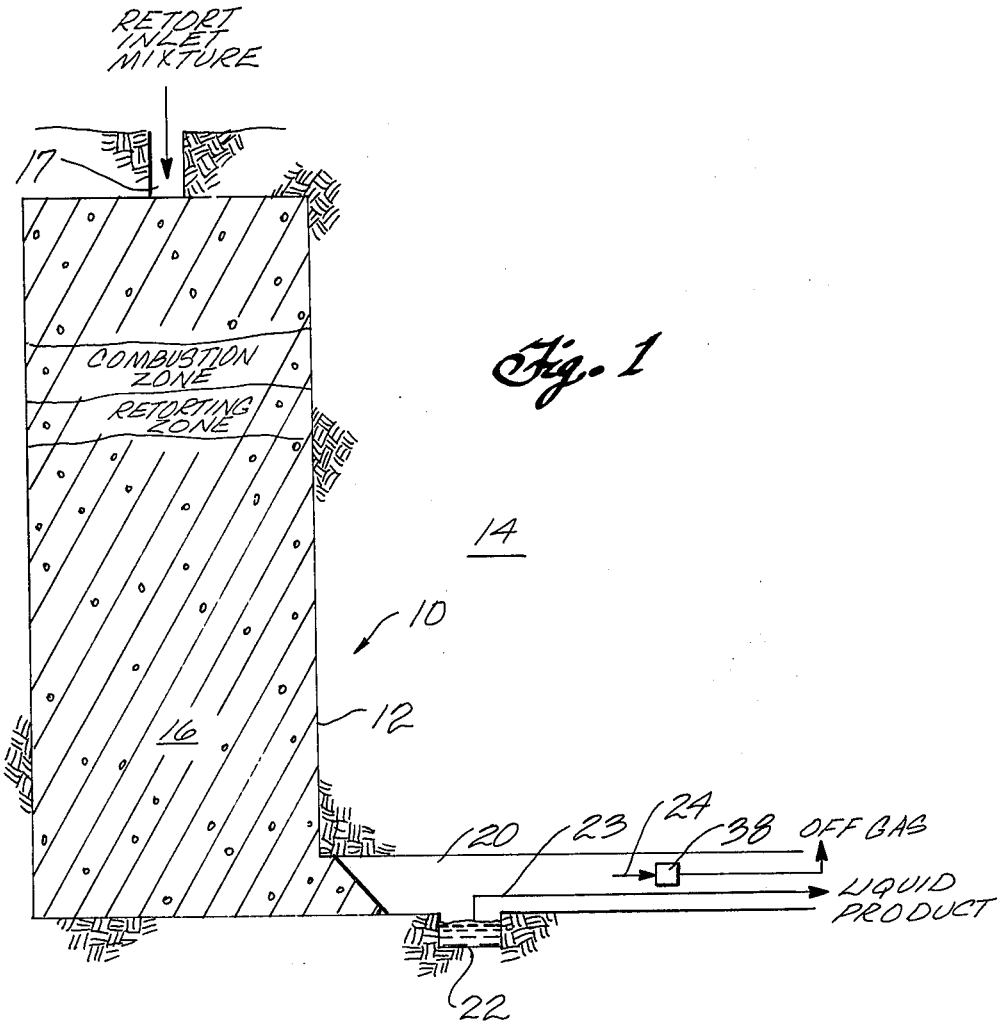
FIG. 1 represents schematically in vertical cross section an in situ oil shale retort.

Referring to FIG. 1, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with fragmentation of the mass of formation particles by blasting by any of a variety of techniques. A desirable technique involves excavating or mining a void within the boundaries of an in situ oil shale retort site to be formed in the subterranean formation and explosively expanding remaining oil shale in the formation toward such a void. Methods of forming an in situ oil shale retort are described in U.S. Pat. Nos. 3,661,423; 4,043,595; 4,043,596; 4,043,597; and 4,043,598. A variety of other techniques can also be used.

The fragmented permeable mass in the retort can have a void fraction of from about 10 to about 30%. By void fraction, there is meant the ratio of the volume of voids or spaces between particles in the fragmented mass to the total volume of the fragmented permeable mass of particles in the retort.

A conduit 17 communicates with the top of the fragmented mass of formation particles. During the retorting operation of the retort 10, a combustion processing zone is established in the retort by ignition of carbonaceous material in oil shale. The combustion zone is advanced through the fragmented mass by introducing an oxygen containing retort inlet mixture into the in situ oil shale retort through the conduit 17 as a combustion zone feed. The retort inlet mixture can be air, or air enriched with oxygen, or air diluted by a fluid such as water, steam, a fuel, recycled off gas, an inert gas such as nitrogen, and combinations thereof. Oxygen introduced to the retort in the retort inlet mixture oxidizes carbonaceous material in the oil shale to produce combustion gas. The combustion processing zone is the portion of the retort where the greater part of the oxygen in the combustion zone feed that reacts with residual carbonaceous material in retorted oil shale is consumed. Heat from the exothermic oxidation reactions, carried by flowing gases, advances the combustion zone through the fragmented mass of particles.

Combustion gas produced in the combustion zone and any unreacted portion of the combustion zone feed pass through the fragmented mass of particles on the advancing side of the combustion zone to establish a retorting processing zone on the advancing side of the combustion zone. Kerogen in the oil shale is retorted in the retorting zone to produce liquid and gaseous products including methane.

Formation 14 containing oil shale contains large quantities of alkaline earth metal carbonates, principally calcium and magnesium carbonates which during retorting and combustion are at least partly calcined to produce alkaline earth metal oxides. For example, oil shale particles in the retort 10 can contain approximately 20 to 30% calcium carbonate and 5 to 10% magnesium carbonate.

Oil shale can contain appreciable quantities of compounds containing sulfur which during retorting and combustion can release sulfur. Exemplary of compounds which can be present in oil shale which contain sulfur are iron disulfide, iron sulfide, and potassium hydrogen sulfate. Also, kerogen can contain sulfur. It has been found that sulfur released by thermal decomposition during retorting and combustion is present in off gas from the retort in the form of hydrogen sulfide.

There is an access tunnel, adit, drift 20 or the like in communication with the bottom of the retort. The drift contains a sump 22 in which liquid products 23, including liquid hydrocarbon products and water, are collected to be withdrawn. An off gas 24 containing gaseous products, combustion gas, carbon dioxide from carbonate decomposition, and any gaseous unreacted portion of the combustion zone feed, is also withdrawn from the in situ oil shale retort 10 by way of the drift 20. The off gas can contain large amounts of nitrogen with lesser amounts of hydrogen, carbon monoxide, carbon dioxide, methane and higher hydrocarbons, water vapor and hydrogen sulfide. The liquid products and off gas are withdrawn from the retort as effluent fluids.

Oil shale typically is horizontally bedded due to the sedimentary nature of oil shale. Layers in the fragmented mass are correlated with strata in the unfragmented formation because there is little vertical mixing between strata when explosively fragmenting particles. Therefore, samples of various strata through the retort can be taken before initiating retorting of the oil shale and assays can be conducted to determine content of a component such as kerogen. Such samples can be taken from within the fragmented mass, from formation in the retort site before expansion, or from formation nearby the fragmented mass since little change in kerogen content of oil shale occurs over large areas of formation.

According to the present invention, the locus of the retorting and/or combustion processing zones can be determined by monitoring off gas from the fragmented means for concentration of a selected constituent. Monitoring means 38 can be provided for monitoring the off gas 24 for the presence of a selected constituent such as methane, hydrogen sulfide, carbon dioxide, and the like. Suitable monitoring means for a constituent such as methane is a gas chromatograph. A gas chromatograph or mass spectrometer is a suitable instrument for rapid analysis of other gaseous constituents.

By monitoring off gas for the concentration of a selected constituent, where the selected constituent is produced from a precursor in the fragmented mass by advancement of a processing zone through the retort, it is possible to determine the content of the precursor in the formation being processed. This is because the concentration of some constituents of off gas withdrawn from an in situ oil shale retort can be correlated with the content of a corresponding precursor in the oil shale being processed. For example, concentration of methane in off gas from an in situ retort is dependent upon the kerogen content of the oil shale being retorted in the retort.

To take advantage of this correlation, formation at selected elevations is assayed for content of the precursor or precursors of a selected constituent present in off gas from the retort to develop a histogram of content of such a precursor versus elevation in the fragmented mass. As noted above, layers in the fragmented mass are correlated with strata in the unfragmented formation because there is little vertical mixing between strata when explosively fragmenting formation to form a fragmented permeable mass of formation particles. Therefore, samples of various strata in the formation can be taken and assays can be conducted to determine the content of the selected precursor at selected elevations in the retort. Such samples can be taken from within the fragmented mass, from formation within the retort site before explosive expansion, and/or from formation nearby the fragmented mass. From the samples and the correlation between off gas concentration of a constituent and the content of the corresponding precursor in the formation, the concentration of the constituent in the off gas can be predicted as a function of the elevation of the processing zone in the fragmented mass. The concentration of the constituent in the off gas can also depend on temperature of the processing zone, and composition, temperature, and gas velocity of the retort inlet mixture.

As used herein, the term "content" is used to refer to the total amount or the concentration of a precursor in the formation, or to the total amount or the concentration of a constituent in the off gas.

To determine the elevation of a processing zone in an in situ oil shale retort, formation is assayed at selected elevations for a precursor for a constituent in the off gas; using a correlation between the concentration of the selected constituent in the off gas and the content of the precursor in oil shale being processed, the concentration of the constituent in the off gas is predicted; the actual concentration of the selected constituent in the off gas is determined; and predicted concentration of the constituent in the gas and actual concentration of the constituent in the off gas are compared. Thus, by knowing the content of a precursor in the fragmented mass 16 at selected elevations, by knowing the correlation between content of a precursor in the fragmented mass and concentration of the selected constituent in the off gas, and by knowing the actual concentration of the selected constituent in the off gas, the elevation of a processing zone in the retort can be determined.

It has been determined that the rate of production of off gas from an in situ retort is dependent on inlet gas conditions and the kerogen content of formation being retorted. Thus, by assaying formation at selected elevations for kerogen content, both the off gas production rate and the concentration of a selected constituent in the off gas when the retorting zone is at such a selected elevation can be predicted. From predicted values for the off gas production rate and concentration of a selected constituent in the off gas, the production rate of the constituent as a function of location of a processing zone can be predicted. By integrating the predicated production rate of the selected constituent over time, the total production of the selected constituent can be predicted.

Therefore, in addition to comparing actual concentration of the constituent in the off gas versus projected or predicted concentration of a constituent in the off gas, it is possible to compare actual production rate with predicted production rate of the constituent and actual total production or content with predicted total production or content of the constituent.

As used herein, by the term "precursor" there is meant a selected component of formation containing oil shale which, due to advancement of a processing zone through the retort, generates a constituent present in off gas from the retort. The precursor is the component of the formation containing oil shale for which an assay is conducted. The constituent of the off gas corresponding to the precursor is the compound for which the off gas is monitored.

A variety of precursor:constituent pairs can be used for determining the locus of a processing zone advancing through a retort. Exemplary of precursor:constituent pairs are kerogen:methane; kerogen:ethane; ferrous sulfide:hydrogen sulfide; and alkaline earth metal carbonates:carbon dioxide.

Kerogen:methane is a preferred precursor:constituent pair because a reasonably good correlation between kerogen content of oil shale and methane content of off gas has been developed. In addition, formation is usually assayed for kerogen content before preparing an in situ oil shale retort regardless of any need to determine the locus of the processing zone. For example, assays can be made for determining inlet gas conditions and making sure that the formation contains sufficient recoverable kerogen to justify the cost of formation and processing of a retort. Therefore, using kerogen:methane as the precursor:constituent pair results in little, if any, additional cost. Thus, the process is herein described in terms of using kerogen as the precursor and methane as the selected constituent.

The methane concentration of off gas from an in situ oil shale retort as retorting of the fragmented mass in the retort progresses can be predicted for each day from startup. This can be done by estimating the advancement rate of the retorting zone through the retort. By predicting the off gas production rate and the methane concentration of the off gas as a function of the elevation of the retorting zone, and by estimating the rate of advancement of the retorting zone through the retort, the methane concentration of the off gas as a function of time from start-up can be predicted. In addition, the total production of methane from the retort can be predicted for each day from start-up. By comparing predicted methane concentration against actual methane concentration as retorting progresses, by comparing actual production rate versus predicted production rate, and/or by comparing actual total production versus predicted total production, it is possible to determine if the retorting zone has deviated from its predicted rate of advancement through the fragmented mass.

Not only can the method of this invention be used for determining the elevation of a processing zone in a fragmented permeable mass in a retort and for detecting deviation from a desired or predicted elevation, it can also be used to determine the orientation of the processing zone. If a processing zone is substantially flat and horizontal, it encounters layers of different content of kerogen relatively abruptly. Thus, changes in methane concentration can clearly be associated with changes in kerogen content. If the retorting zone is skewed or significantly warped, it can encounter several layers of different kerogen content at substantially the same time, thereby tending to obscure the correlation between methane concentration and the location of the retorting zone in the fragmented mass. In essence, the first derivative of the methane concentration as a function of time is reduced when the retorting zone is skewed or nonplanar as compared with the first derivative of the methane concentration when the retorting zone is substantially flat and horizontal. Thus, it is possible to determine if the retorting zone is substantially planar and substantially normal to its direction of advancement by comparing the first derivative of determined methane content of the off gas and methane production rate with the first derivative of predicted methane content and methane production rate, respectively.

In summary, by monitoring the content in the off gas of a selected constituent produced in the retort, one can determine not only the location of a processing zone in the retort, but also deviations of the processing zone from its desired shape or orientation.

The following example demonstrates a method embodying features of this invention:

EXAMPLE

A retort was formed in the south-southwest portion of the Piceance Creek Basin of Colorado. The retort contained a fragmented permeable mass of formation particles which were formed by explosively expanding formation toward a vertically extending void. The fragmented mass had an average void fraction of about 17%. The fragmented mass was square with side dimensions of about 118 feet and was about 165–200 feet high with a sloping bottom boundary. The oil shale in the fragmented mass was in horizontal strata, i.e., the fragmented mass comprised horizontal layers, the oil shale in each layer having about the same kerogen content.

Prior to forming the fragmented permeable mass, core samples of formation were taken and analyzed for kerogen content by Fischer assay. The results of this analysis are presented on the left of FIG. 4, which shows a histogram of oil shale grade versus depth below the top of the fragmented mass in the retort.

Figure 2:
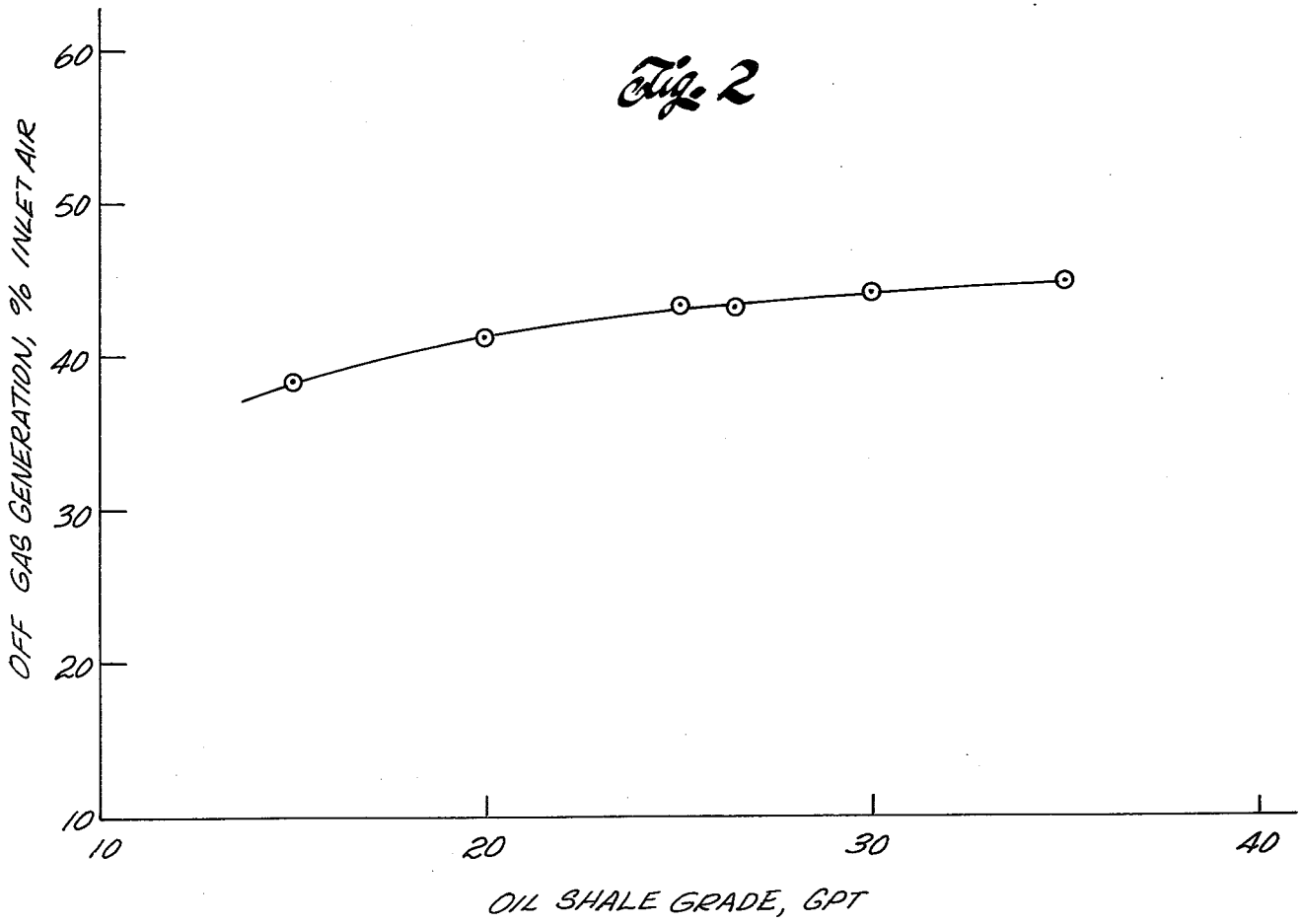
FIG. 2 shows off gas generation rate as a function of oil shale grade for an in situ oil shale retort like that of FIG. 1.

Methane concentration in the off gas and off gas production rate as a function of oil shale grade were projected for this retort, and the results are presented in FIGS. 3 and 2, respectively. These projections were based on the assumption that the retort inlet mixture consisted of 70% air and 30% steam, and was introduced to the retort by a rate of 0.62 SCFM (standard cubic foot per minute) per square foot cross-sectional area of the fragmented mass. The projection presented in FIG. 2 is estimated to be accurate with ±25%.

It was estimated that the retorting zone would advance through the fragmented permeable mass at an average rate of a little greater than 1 foot per day. Using this rate of advancement, the retorting zone location as a function of days from start-up was estimated and plotted in FIG. 4.

Based on the predicted retorting zone location and oil shale grade histogram presented in FIG. 4, and projected methane concentration in off gas as a function of oil shale grade as shown in FIG. 3, the methane concentration in the off gas was predicted, and is also presented in FIG. 4.

A combustion zone was established in the fragmented mass using liquefied petroleum gas as a fuel. Once the combustion zone was established, introduction of fuel was stopped. The combustion zone was advanced downwardly through the fragmented mass using a retort inlet mixture consisting of 70% air and 30% steam at a volumetric flow rate of about 0.62 SCFM per square foot of cross-sectional area of the fragmented permeable mass. The actual methane concentration in the off gas from the retort was monitored, and is plotted in FIG. 4.

As shown in FIG. 4, the measured methane concentration was higher than the predicted methane concentration through about day 20 from start-up. It is believed that this was caused by gas flow channeling in the retort, where the combustion and retorting zones advanced in one region of the retort rather rapidly while advancing more slowly in other regions. Thus, the retorting zone was in the shape of a spike extending in part into a region of rich oil shale in the fragmented mass about 50 feet below the top of the fragmented mass. In other words, the retorting zone was not planar, and a portion of it had advanced on about the 15th day from start-up to an elevation in the fragmented mass to which it should have advanced until about the 45th day from start-up.

This conclusion was reinforced by the temperature of the off gas, which was higher than predicted. Therefore, corrective measures were taken to establish a substantially flat retorting zone.

Monitoring the locus of a processing zone such as a combustion zone or retorting zone advancing through the fragmented permeable mass 16 in the retort 10, has significant advantages. For example, steps can be taken to maintain the combustion zone flat and uniformly perpendicular to the direction of its advancement to minimize oxidation and excessive cracking of hydrocarbons produced in the retorting zone. Furthermore, knowledge of the locus of the combustion and retorting zones as they advance through the retort allows monitoring the performance of a retort. Knowledge of the locus of the combustion and retorting zones also allows optimization of the rate of advancement to produce hydrocarbon products with the lowest expense possible by varying the composition of and introduction rate of the retort inlet mixture.

A further advantage of the method of this invention is that analysis of the off gas is relied upon for determining the locus of a processing zone rather than analysis of liquid products from the retort. It is found that the composition and properties of the off gas or more quickly responsive to changes in the retorting process than the composition and properties of the liquid products. Gases can pass downwardly through the retort at 5 feet per minute and faster.

Although this invention has been described in detail with reference to certain versions thereof, other versions of this invention can be practiced. For example, instead of comparing predicted and actual concentrations, production rates, and/or total production of a selected constituent of the off gas, predicted and actual ratios of the concentrations, production rates, and/or total production of two selected constituents can be compared. Such pairs can be selected from the following constituents of retort off gas: hydrogen, hydrogen sulfide, carbon monoxide, carbon dioxide, methane, ethane, propane and butane.

Therefore, the spirit and scope of the appended claims should not be limited to the description of the preferred versions contained herein.

What is claimed is:

1. A method for determining the locus of a processing zone advancing through a fragmented permeable mass of particles containing oil shale in an in situ oil shale retort in a subterranean formation containing oil shale, the retort having boundaries of unfragmented formation and the retort having an effluent gas passing therefrom containing a selected constituent, the selected constituent being formed from at least one precursor contained in the formation by advancement of the processing zone through the fragmented mass, the method comprising the steps of:

determining content of such a precursor in formation at a plurality of locations in the retort before processing such locations;

predicting concentration of the selected constituent in effluent gas from the retort due to processing fragmented mass at at least a portion of such locations;

monitoring effluent gas from the retort for the concentration of the selected constituent; and correlating the concentration of the selected constituent with such predicted concentrations for determining the locus of the processing zone in the retort.

2. The method of claim 1 wherein the kerogen content of formation is determined and the selected constituent is methane.

3. The method of claim 1 wherein the processing zone is a combustion zone.

4. The method of claim 1 wherein the processing zone is a retorting zone.

5. The method of claim 1 wherein the step of determining comprises assaying formation which is outside the boundaries of the retort for such a precursor and correlating the results of assaying to a plurality of locations within the boundaries of the retort.

6. The method of claim 1 wherein the step of determining comprises assaying formation which is within the boundaries of the retort.

7. A method for determining the locus of a processing zone advancing through a fragmented permeable mass of particles containing oil shale in an in situ oil shale retort in a subterranean formation containing oil shale, the retort having boundaries of unfragmented formation, the oil shale containing kerogen, the retort having an effluent gas passing therefrom containing methane formed from kerogen in the oil shale, the method comprising the steps of:

determining kerogen content in formation at a plurality of locations in the retort before processing such locations;

predicting methane concentration in effluent gas from the retort due to retorting kerogen at at least a portion of such locations;

monitoring effluent gas from the retort for methane concentration; and correlating the concentration of methane in the effluent gas with such predicted methane concentrations for determining the locus of the processing zone in the retort.

8. The method of claim 7 wherein the processing zone is a retorting zone.

9. The method of claim 7 wherein the step of determining comprises assaying formation which is outside the boundaries of the retort for such a precursor and correlating the results of assaying to a plurality of locations within the boundaries of the retort.

10. The method of claim 7 wherein the step of determining comprises assaying formation which is within the boundaries of the retort.

11. A method for determining the locus of a processing zone advancing through a fragmented permeable mass of particles containing oil shale in an in situ oil shale retort in a subterranean formation containing oil shale, said retort having an off gas withdrawn therefrom, and said subterranean formation including a plurality of generally horizontal strata having different contents of a selected precursor corresponding to a selected constituent of the off gas, the method comprising the steps of:

forming an in situ oil shale retort containing a fragmented permeable mass of formation particles containing oil shale in the formation, the fragmented mass containing generally horizontal layers of particles correlated with such strata;

assaying the formation at selected elevations for content of the selected precursor in the fragmented mass;

predicting production rates of the selected constituent from the precursor at selected elevations in the fragmented mass;

establishing a processing zone in the fragmented mass;

introducing a processing gas to an upper portion of the fragmented mass for advancing the processing zone downwardly through the fragmented mass and for retorting oil shale in the fragmented mass with generation of the selected constituent from the selected precursor;

withdrawing off gas containing the selected constituent from a lower portion of the retort;

monitoring off gas withdrawn from the fragmented mass for concentration of the selected constituent;

determining a production rate of the selected constituent from the retort; and comparing such a determined production rate of the selected constituent from the retort with such a predicted production rate of the selected constituent.

12. The method of claim 11 wherein the comparing step comprises comparing the first derivative of such a determined production rate of the selected constituent versus time with the first derivative of such a predicted production rate of the selected constituent versus time.

13. A method for determining the locus of a processing zone advancing downwardly through a fragmented permeable mass of particles containing oil shale in an in situ oil shale retort in a subterranean formation containing oil shale, said subterranean formation including a plurality of generally horizontal strata having different kerogen contents comprising the steps of:

forming an in situ oil shale retort containing a fragmented permeable mass of formation particles containing oil shale in the formation, the fragmented mass containing generally horizontal layers of particles correlated with such strata;

determining kerogen content in layers in the fragmented mass at selected elevations;

predicting production rates of methane from the kerogen content in layers in the fragmented mass;

establishing a processing zone in the fragmented mass;

introducing a processing gas to an upper portion of the fragmented mass for advancing the processing zone downwardly through the fragmented mass and for retorting oil shale therein;

withdrawing off gas containing methane from a lower portion of the fragmented mass;

monitoring off gas from the fragmented mass for methane concentration;

determining a production rate of methane from the retort;

comparing such a determined production rate of methane from the retort with such a predicted production rate of methane.

14. The method of claim 13 wherein the processing gas contains oxygen and the processing zone is a combustion zone.

15. The method of claim 13 wherein the comparing step comprises comparing the first derivative of such a determined methane production rate versus time with the first derivative of such a predicted methane production rate versus time.

16. A method for determining the locus of a processing zone in a fragmented mass in an in situ oil shale retort in a subterranean formation containing oil shale, such as in situ oil shale retort containing a fragmented permeable mass of formation particles containing oil shale, the method comprising the steps of:

determining content of a selected component in such formation at a plurality of elevations in the fragmented mass in an in situ oil shale retort;

introducing an inlet gas to an upper portion of the fragmented mass in the in situ oil shale retort;

withdrawing an off gas from a lower portion of the fragmented mass in the in situ oil shale retort, the off gas containing a gaseous constituent generated from the selected component by reason of such introduction of an inlet gas to the fragmented mass;

predicting production of the gaseous constituent in off gas withdrawn from the fragmented mass as a function of inlet gas properties and selected component content of formation at at least one elevation in the fragmented mass;

measuring concentration of the gaseous constituent in off gas withdrawn from the fragmented mass;

measuring off gas production rate;

determining production of the gaseous constituent; and comparing determined production of the gaseous constituent with predicted production of the gaseous constituent for at least one elevation in the fragmented mass.

17. The method of claim 16 wherein the selected component is kerogen and the gaseous constituent is methane.

18. The method of claim 16 wherein the selected component is kerogen and the gaseous constituent is methane.

19. A method for determining if a processing zone advancing through a fragmented permeable mass of particles containing oil shale in an in situ oil shale retort in a subterranean formation containing oil shale is substantially planar and substantially normal to its direction of advancement through the fragmented mass, the retort having an effluent gas passing therefrom containing a selected constituent, the selected constituent being generated from at least one precursor contained in the formation by advancement of the processing zone through the fragmented mass, the method comprising the steps of:

(a) determining content of such a precursor in formation at selected locations in the retort before processing the selected locations;

(b) predicting the first derivative of the production rate of the selected constituent versus time for such selected locations;

(c) monitoring effluent gas from the retort for concentration of the selected constituent;

(d) determining the rate at which effluent gas passes from the retort;

(e) determining production rate of the selected constituent;

(f) determining the first derivative of the production rate of the selected constituent in the effluent gas versus time; and (g) comparing such a determined first derivative with such a predicted first derivative.

20. The method of claim 19 wherein the precursor is kerogen and the selected constituent is methane.

21. A method for determining the locus of a processing zone in a fragmented mass in an in situ oil shale retort in a subterranean formation containing oil shale, such an in situ oil shale retort containing a fragmented permeable mass of formation particles containing oil shale, the method comprising the steps of:

determining content of a selected component in such formation at a plurality of elevations in the fragmented mass in an in situ oil shale retort;

introducing an inlet gas to an upper portion of the fragmented mass in the in situ oil shale retort;

withdrawing an off gas from a lower portion of the fragmented mass in the in situ oil shale retort, the off gas containing a gaseous constituent generated from the selected component by reason of such introduction of an inlet gas to the fragmented mass;

predicting concentration of the gaseous constituent in off gas withdrawn from the fragmented mass as a function of inlet gas properties and selected component content of formation at at least one elevation in the fragmented mass;

measuring concentration of the gaseous constituent in off gas withdrawn from the fragmented mass; and comparing measured concentration of the gaseous constituent with predicted concentration of the gaseous constituent for at least one elevation in the fragmented mass.

22. A method for determining if a processing zone advancing through a fragmented permeable mass of particles containing oil shale in an in situ oil shale retort in a subterranean formation containing oil shale is substantially planar and substantially normal to its direction of advancement through the fragmented mass, the retort having an effluent gas passing therefrom containing a selected constituent, the selected constituent being generated from at least one precursor contained in the formation by advancement of the processing zone through the fragmented mass, the method comprising the steps of:

(a) determining content of such a precursor in formation at selected locations in the retort before processing the selected locations;

(b) predicting the first derivative of the concentration of the selected constituent in the effluent gas versus time for such selected locations;

(c) monitoring effluent gas from the retort for concentration of the selected constituent;

(d) determining the first derivative of the concentration of the selected constituent in the effluent gas versus time; and (e) comparing the determined first derivative with such a predicted first derivative.

23. The method of claim 22 wherein the precursor is kerogen and the selected constituent is methane.

24. A method for determining the locus of a processing zone advancing through a fragmented permeable mass of particles containing oil shale in an in situ oil shale retort in a subterranean formation containing oil shale, the retort having an effluent gas passing therefrom containing a selected constituent, the selected constituent being generated from at least one precursor contained in the formation by advancement of the processing zone through the fragmented mass, the method comprising the steps of:

determining content of such a precursor in formation at a plurality of locations in the retort before processing such locations;

predicting the concentration of the selected constituent in the effluent gas versus time due to processing such locations;

monitoring effluent gas from the retort for concentration of the selected constituent; and comparing the concentration of the selected constituent in the effluent gas and the predicted concentration of the selected constituent versus time for determining the locus of a processing zone in the retort.

25. The method of claim 24 wherein the precursor is kerogen and the selected constituent is methane.

* * * * *

UNITED STATES PATENT AND TRADEMARK OFFICE

CERTIFICATE OF CORRECTION

PATENT NO. : 4,166,721

DATED : September 4, 1979

INVENTOR(S) : Chang Yul Cha

It is certified that error appears in the above-identified patent and that said Letters Patent are hereby corrected as shown below:

Column 2, line 61, "conbustion" should be -- combustion --.

Column 6, line 45, "predicated" should be -- predicted --.

Column 8, line 34, "with" should be -- within --.

Column 9, line 3, -- not -- should be inserted after "should" and before "have".

Column 12, line 35, "16" should be -- 21 --.

Signed and Sealed this

*Eleventh* Day of *December 1979*

[SEAL]

*Attest:*

SIDNEY A. DIAMOND

*Attesting Officer*

*Commissioner of Patents and Trademarks*